United States Patent [19]

Koren

[11] 4,359,938

[45] Nov. 23, 1982

[54] PRINTING ROLLER FOR REMOVING HICKEYS

[76] Inventor: Edward F. Koren, 6340 A Americana Dr., Clarendon Hills, Ill. 60514

[21] Appl. No.: 218,114

[22] Filed: Dec. 19, 1980

[51] Int. Cl.[3] ..... B41F 13/08; B41F 31/20

[52] U.S. Cl. ..... 101/148; 101/348; 101/426; 29/132

[58] Field of Search ..... 29/118, 120, 132; 101/147, 148, 348, 426

[56] References Cited

U.S. PATENT DOCUMENTS

| | | | |
|---|---|---|---|
| 2,966,723 | 1/1961 | Swope | 29/120 |
| 3,030,696 | 4/1962 | Serwer | 29/132 |
| 3,183,578 | 5/1965 | Kennedy, Jr. | 29/120 |
| 3,308,522 | 3/1967 | Miller | 29/120 |
| 3,402,449 | 9/1968 | Schröder | 29/132 |
| 3,467,009 | 9/1969 | Ross | 29/132 |
| 3,617,445 | 11/1971 | Brafford | 29/120 |
| 3,635,158 | 1/1972 | Budinger | 101/147 |
| 3,639,957 | 2/1972 | Mitchell, Jr. | 29/120 |
| 3,800,381 | 4/1974 | Boadford | 29/132 |
| 3,808,657 | 5/1974 | Menges et al. | 29/120 |
| 3,878,622 | 4/1975 | Knechtel et al. | 29/132 |
| 3,926,701 | 12/1975 | Nishiwaki | 29/132 |
| 3,998,681 | 12/1976 | Williams et al. | 29/120 |
| 4,052,777 | 10/1977 | Mendec | 29/120 |

*Primary Examiner*—William Pieprz

*Attorney, Agent, or Firm*—Merriam, Marshall & Bicknell

[57] ABSTRACT

An improved printing roller and method of making same, wherein a soft, loose, long nap fabric having a backing is bonded onto a roller shaft. The fabric is impregnated with a resilient elastomeric binder to form a homogeneous roller medium from the shaft to the roller surface. The homogeneous roller medium is grinded to raise a soft, loose nap on the roller surface.

8 Claims, 5 Drawing Figures

PRINTING ROLLER FOR REMOVING HICKEYS

This invention relates to printing rollers and to a method of making printing rollers, particularly of the type used in offset printing for removing undesired foreign material during the printing process and for dampening or moistening rollers.

BACKGROUND OF THE INVENTION

Reference may be made to the following U.S. Patents of interest: Nos. 3,635,158; 3,808,657; 4,052,777; 3,594,255.

In offset printing, foreign material occasionally undesirably accumulates on the printing plate surface and is then impressed on the finished printed matter by the chain of printing rollers. These undesired foreign objects, known as "hickeys", can be removed by stopping the printing process and cleaning the printing plate with liquid commercially available for this purpose. In an attempt to avoid the printing operation shut-down, various printing roller structures, termed "hickey rollers", have been proposed for insertion in the printing roller chain to remove the undesired foreign objects by picking or whisking them off of the printing plate during the printing process.

One type hickey roller in past use employs a sleeve of leather over a rubber core. Some of the above-listed U.S. patents illustrate other proposed hickey rollers, which in general, suggest a multiple layer roller structure wherein a dense, felt fabric surface layer is applied over a printing roller rubber core. The felt surface is grinded to raise the compressed felt nap to aid in removing hickeys. Other proposed multiple layer hickey rollers involve depositing textile fibers by flocking onto the roller core surface.

It is now desired to provide an improved printing roller for removing hickeys, which improved roller more effectively removes hickeys and wherein the roller can be more readily cleaned than prior rollers. Also, it is desired to provide an improved method of making such a roller. Further, it is desired to provide an improved printing roller for use as a dampening roller.

SUMMARY OF THE INVENTION

A metal printing roller shaft is spirally wrapped with a soft, loose, long nap fabric having a backing bonded or cemented directly onto the metal shaft. The fabric is then impregnated with a resilient elastomeric binder, such as polyvinylchloride (PVC) or polyurethane and allowed to cure thereby forming a homogeneous roller medium from the shaft to the roller surface. The impregnated fabric is then grinded to raise a soft, loose nap on the surface of the homogeneous roller medium.

There is thus eliminated the prior art need for a rubber core to be provided on the standard metal roller shaft prior to applying the prior art dense felt fabric surface layer. Instead, in accordance with the present invention, a resilient roller core and the desired printing roller surface are both provided by the initially soft, loose, long nap fabric applied directly onto the metal roller shaft and thereafter impregnating the fabric with a resilient binder. Furthermore, upon curing and grinding the impregnated fabric surface, it has been found that the loose, long nap fabric after grinding provides a surface layer consisting of more soft and loose fibers available for removing hickeys as compared to the prior art dense, compressed, felt fabric. In addition, the single fabric impregnated with an elastomeric binder in the present invention is homogeneous and therefore substantially non-porous throughout the entire roller—from the roller surface down through the roller core to the metal shaft. This enables a quicker release of printing ink from the roller and thus an easier and faster clean up of the rollers as compared to the non-homogeneous, multiple layer rollers of the prior art.

In the preferred embodiment of the invention, the roller shaft is spirally wrapped with a fiber fabric having a soft, loose nap about one inch long, composed of a fiber mixture of about 6 to 15 denier. The fabric is impregnated with PVC having a hardness rating of about 20 to 25 durometer, Shore A and cured so that the final roller has a hardness rating of about 30–50 durometer.

BRIEF DESCRIPTION OF THE DRAWINGS

The invention may be understood by reference to the following description taken in conjunction with the accompanying drawings in which like reference numerals identify like elements in the several figures and in which.

DETAILED DESCRIPTION

Figure 1:
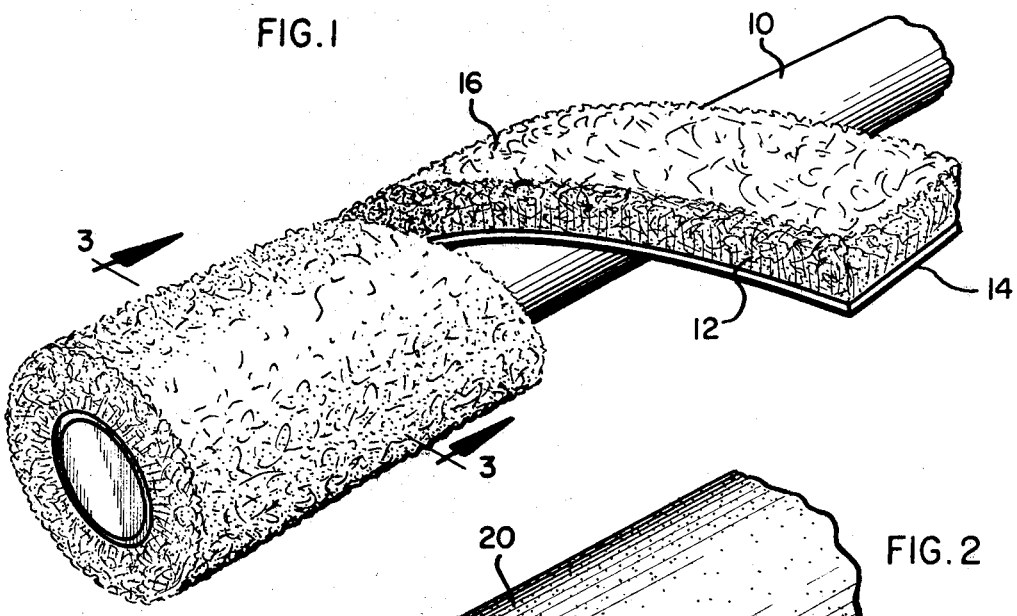
FIG. 1 is a perspective view illustrating a metal printing roller shaft onto which is spirally wrapped a soft, loose, long nap fiber fabric with a backing bonded or cemented onto the shaft.

With reference to FIG. 1, there is illustrated a printing roller metal shaft 10 which has been covered by an epoxy cement or other bonding material. A strip of fiber fabric 12 having a backing 14 is spirally wound onto shaft 10 with the strip edges butting together. Fiber fabric 12 comprises a soft, loose, long nap 16 projecting upwardly from the backing. Fabric 12 can be a commercially available fabric sold under the name "FABNAP" in which the nap 16 is formed of loose, plush polyester fibers about 1 inch long. Other commercially fabrics can be utilized as long as they comprise a backing with soft, loose, plush nap as opposed to an undesired felted fabric with compressed fibers. The nap 16 preferably comprises a mixture of fiber fabrics with deniers of about 6 to 15.

After applying the fabric to the roller shaft, the adhesive is allowed to dry and the nap is then picked or brushed in order to form a unified blend. Next, the fabric is impregnated with a resilient elastomeric binder such as polyvinylchloride (PVC) having a hardness rating of about 20–25 durometer, Shore A. Other elastomeric binders, such as polyurethane, may also be used.

Preferably, the fabric covered shaft and a mold containing PVC are initially pre-heated. The fabric covered shaft is then centered in the mold and submersed therein while maintaining the roller in the center of the mold. Alternatively, the roller core can be placed in the mold and heated PVC could be poured into the mold to submerse the core. In either event, it is desired that the fiber impregnation be carried out with the mold under pressure to ensure that the PVC will impregnate the entire fabric. The impregnated roller core is then placed in an oven for curing so that the impregnated fabric has a hardness rating of about 30–50 durometer, Shore A. Next, the cured roller core is trimmed to size and the surface is grinded to raise a nap of the loose fibers.

Figure 2:
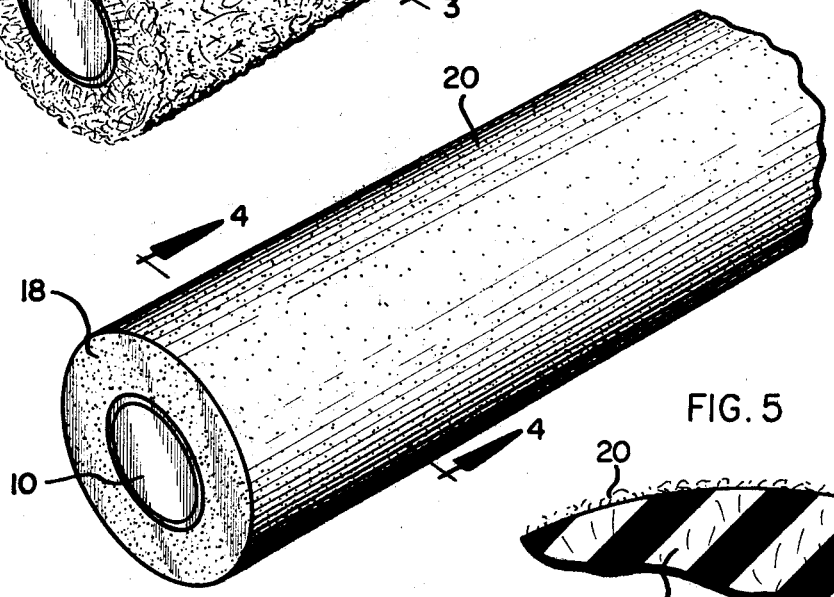
FIG. 2 is a perspective view illustrating the improved roller after impregnation with a resilient binder and grinding the surface to raise a nap.
Figure 5:
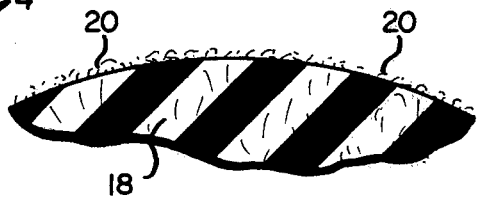
FIG. 5 is a fragmentary exploded view illustrating the substantial nap formed along the printing roller surface by grinding the impregnated fiber fabric of FIG. 2.
Figure 3:
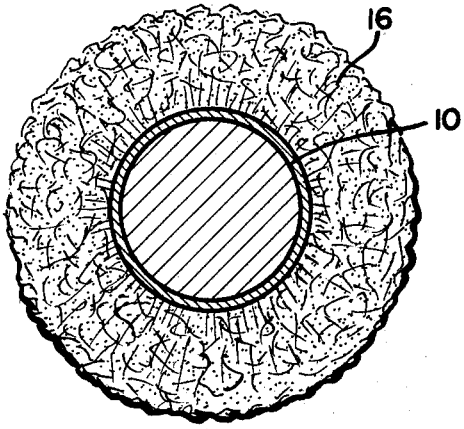
FIG. 3 is a sectional view taken along section line 3—3 of FIG. 1 showing the soft, loose, high nap fabric covering the roller shaft.

FIG. 2 illustrates the metal roller shaft 10 with the binder impregnated fiber fabric consisting of a homogeneous medium 18 with the grinded surface forming a loose nap 20. The exploded view of FIG. 5 illustrates more clearly the substantial amount of nap raised on the lower surface by grinding which is obtained from the initial soft, loose, long nap 16 shown in FIGS. 1 and 3.

Figure 4:
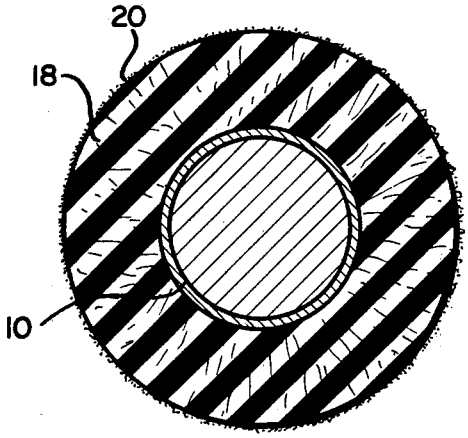
FIG. 4 is a sectional view taken along section line 4—4 of FIG. 2 illustrating the raised nap roller surface and the resilient roller core as one homogeneous medium.

Further, FIG. 4 illustrates the homogeneous medium from shaft 10 to the printing roller surface which provides a single, substantially non-porous material throughout the roller, allowing a quicker release of the printing ink from the roller during clean up. It may also be recognized that the substantial increase in loose nap 20 on the printing roller surface compared to the prior art provides the roller of the present invention with a better affinity for ink, thereby providing improved printing results.

It has been found that the improved printing roller described above also is useful as a dampening or moistening roller in a printing roller chain.

The foregoing detailed description has been given for clearness of understanding only, and no unnecessary limitations should be understood therefrom, as modifications will be obvious to those skilled in the art.

What is claimed is:

1. A method of making a printing roller comprising the steps of:

providing a metal roller shaft;

providing an unfelted fiber fabric having a backing and a loose, plush nap the fibers of which have one end bound to said backing and a free end projecting outwardly from said backing at least one inch with a fiber denier of about 6–15;

cementing the fiber fabric backing to said roller shaft;

impregnating the nap fibers and backing with a resilient binder to completely fill the pores in said nap and backing and forming a single layer roller medium extending outwardly from said roller shaft; and grinding the roller medium surface of the impregnated fabric to raise a nap on the outer surface thereof.

2. The method of claim 1, wherein said unfelted fiber fabric is in the form of a long strip with the backing cemented by spiral wrapping the strip on said roller shaft.

3. The method of claim 2, wherein the formed roller medium is immersed in a heated resilient binder during impregnation.

4. A printing roller having a metal roller shaft and a single layer roller medium extending outwardly from said roller shaft to a roller surface, said single layer roller medium comprising an unfelted fiber fabric having a backing and a loose, plush nap the fibers of which have one end bound to said backing and and a free end projecting outwardly from said backing at least one inch with a fiber denier of about 6–15, and which fiber nap and backing have been impregnated with a resilient binder, to form said single layer roller medium the single layer roller medium being ground to form a raised nap on said roller surface.

5. A printing roller according to claim 4, wherein said binder comprises a resin with a hardness of about 20–25 durometer, and said roller has a hardness of about 30–50 durometer.

6. A printing roller according to claim 5, wherein said binder comprises polyvinylchloride.

7. A printing roller according to claim 4, wherein said fiber fabric backing is bonded to said roller shaft.

8. A printing roller according to claim 4, wherein said unfelted fiber fabric comprises polyester fibers.

* * * * *